United States Patent [19]

Willcox

[11] Patent Number: 4,746,152

[45] Date of Patent: May 24, 1988

[54] DOOR LOCK

[76] Inventor: Robert L. Willcox, 6636 E. 88 St., Tulsa, Okla. 74133

[21] Appl. No.: 90,218

[22] Filed: Aug. 27, 1987

[51] Int. Cl.[4] ..... E05C 1/10

[52] U.S. Cl. ..... 292/150; 292/337; 292/341.15; 292/162

[58] Field of Search ..... 292/150, 145, 147, 302, 292/337, 341.15, 149, 162; 70/33

[56] References Cited

U.S. PATENT DOCUMENTS

| | | | |
|---|---|---|---|
| 43,145 | 6/1964 | Warner . | |
| 188,134 | 3/1877 | Hill . | |
| 257,141 | 4/1882 | Purves . | |
| 284,519 | 9/1883 | Warren . | |
| 291,352 | 1/1884 | Jewett . | |
| 488,509 | 12/1892 | Sweeney | 292/149 X |
| 995,232 | 6/1911 | Edgar, Sr. . | |
| 1,015,338 | 1/1912 | Peel . | |
| 1,086,365 | 2/1914 | Hendren . | |
| 1,159,877 | 11/1915 | Smith . | |
| 1,364,757 | 1/1921 | Herrman | 292/150 |
| 1,410,841 | 3/1922 | Simpson . | |
| 1,520,509 | 12/1924 | Rancour . | |
| 1,617,813 | 3/1926 | Judge | 292/150 |
| 2,496,944 | 2/1950 | James | 292/341.15 X |
| 2,546,149 | 3/1951 | Bowzer | 292/150 X |
| 2,673,109 | 3/1954 | Frost | 292/150 X |
| 3,264,018 | 8/1966 | Houvener . | |
| 3,347,581 | 10/1967 | Hann | 292/147 |
| 3,918,752 | 11/1975 | Leone et al. | 292/150 |
| 4,021,063 | 5/1977 | Porter | 292/67 |
| 4,341,408 | 7/1982 | Blevins | 292/150 |

*Primary Examiner*—Richard E. Moore

*Attorney, Agent, or Firm*—Robert E. Massa

[57] ABSTRACT

A bolt mountable on adjacent members, such as a door and a door frame, to hold the members lockably secure, comprises a bolt assembly on a first member and a keeper assembly on the second member. The bolt assembly includes a flat, elongated slide bolt slidably therein. The slide bolt has a locking pin opening at one end to receive and hold securely a locking pin of the keeper assembly, and a control stem at the other end extending through a slot in the bolt to the exterior. A pair of shoulders at the end of the slide bolt define a narrow passageway communicating with the locking pin opening. A narrow stem is connected axially to the locking pin and extends through an opening in the keeper assembly cover to the exterior of the bolt. A coil spring below the locking pin urges the locking pin toward the exterior. To lock the bolt, the locking pin stem is depressed manually so that the stem may be aligned with the passageway of the slide bolt, the slide bolt is moved toward the locking pin, and the locking pin stem is released, permitting the coil spring to urge the locking pin into locking position within the locking pin opening.

10 Claims, 3 Drawing Sheets

DOOR LOCK

FIELD OF THE INVENTION

My invention relates to safety bolts. More particularly, my invention relates to safety bolts to hold adjacent members in a secure or locked position. Still more particularly, my invention relates to safety bolts positionable upon the surface of adjacent members for holding the members secure, the safety bolts actuable only from the side of the adjacent members upon which the safety bolts are placed.

BACKGROUND OF THE INVENTION

Locking devices for doors have been known for at least four thousand years, and probably originated in the Near East, where early forms of wooden locks operated by keys have been found in Egypt. Since this early period, the term lock has referred to a fastening device which included a bolt movable into a secure position by a key.

Eventually, because of improved technology, the term lock has become broader in meaning to encompass a fastening, as for a door, box, trunk lid, drawer, etc., in which a bolt is secured by any of various cooperating mechanisms and can be released by inserting and turning a key or by operating a special device, such as a combination, timing clock, automatic release button, magnetic solenoid, or other means.

Thus, a bolt may be best exemplified as a bar which is movable within a guide attached to a door to permit an end of the bar to fit into a fixed socket, or keeper, on an adjacent door jamb. Usually, a bolt is constructed so that the entire operating structure may be mounted on the surface of the door, lid, drawer, or other movable apparatus which requires securing or protection.

A typical bolt is intended to be controlled from just one side of a closure, as for example, the interior side of a house door. Too frequently, only a few small wood screws are provided for holding the bolt in place on a door where security is desired. Consequently, an intruder may simply force the door open easily without exerting a great deal of force, because the small wood screws are easily dislocated and because the door jamb is usually a weak structure.

The prior art describes numerous bolt and lock devices, such as those found in the following U.S. Pat. Nos.: 43,145, Warner, June 14, 1864, 188,134, Hill, Mar. 6, 1877, 257,141, Purves, Apr. 25, 1882, 284,519, Warren, Sept. 4, 1883, 291,352, Jewett, Jan. 1, 1884, 995,232, Edgar, Sr., June 13, 1911, 1,015,338, Peel, Jan. 23, 1912, 1,086,365, Hendren, Feb. 10, 1914, 1,159,877, Smith, Nov. 9, 1915, 1,364,757, Herrman, Jan. 4, 1921, 1,410,841, Simpson, Mar. 28, 1922, 1,520,509, Rancour, May 10, 1922, 1,617,813, Judge, Feb. 15, 1927, 3,264,018, Houvener, Aug. 2, 1966, 3,918,752, Leone et al, Nov. 11, 1975, 4,021,063, Porter, May 3, 1977, 4,341,408, Blevins, July 27, 1982.

SUMMARY OF THE INVENTION

The primary object of my invention is to provide a bolt which is sturdy, strong, and yet simple in construction and easy to use.

Another object of my invention is to provide a bolt which is of unique construction and lockably secure in a convenient and efficient manner.

Still another object of my invention is to provide a bolt which is easily maneuverable into and out of a locking condition with minimum effort.

Still another object of my invention is to provide a bolt which is easily applicable to various types of closure members.

Still another object of my invention is to provide a strong, secure lock which has the innate quality of indicating a locked or unlocked condition, capable of being assessed from a distance.

I have been associated with the building and construction business for a long time, and consequently I am aware that the construction methods and materials prevalent in homes and offices have in recent times given us rather inadequate security in these areas.

For example, in the construction of homes, door locks are installed on weak doors and door jambs with only a few short wood screws. The bolt member of the customary door lock enters the keeper for only a short distance, and the keeper itself is situated within a thin portion of the door jamb. A sharp blow, as by a kick or sudden push may easily open most doors.

Even when a dead bolt is used in addition to the regular lock, the same low resistance to force is present because, again, the keeper of the dead bolt is set within the weak door jamb. Of course, when a dead bolt is used in addition to the conventional door lock, the force required to break open the door is increased, but is still not great.

A typical bolt which is mounted on the interior surface of a door will provide even less security because usually the keeper portion of such a lock is held on the door jamb by a few wood screws and, in this arrangement, the screws are in line with the direction of the force which can be applied to the exterior of the door in forcing the door open.

A simple key lock may be easily opened from outside a door by someone who has good knowledge of locks and the proper equipment. More complicated key locks might present some difficulty for the less experienced person.

Then, bolts, as I use the term to refer to locking devices which have a slide bolt member which moves into locking position within a keeper, are mounted on an interior side of a door, window, or the like, and are not operable by a key, and will usually be more resistant to furtive opening from the exterior.

With the knowledge I have gained from experience in the construction industry, I have designed a bolt which, by my experimentation and testing, is greatly resistance to force applied to the outer surface of a door while my bolt is in a locking position.

I have accomplished this advantage, most importantly, by designing a bolt which completely by-passes the door jamb. I have designed my bolt so that one component of the bolt, for example, the keeper assembly portion, is mounted on a solid portion of the door, and another component, for example, the bolt assembly, is mounted on a solid portion of the door frame, completely beyond the door jamb. In other words, in one manner of mounting, the bolt assembly is positioned on the wall farther from the edge of the door than the door jamb.

Then, because I have designed my bolt to be mounted in these solid areas of the door and wall frame, I am able to use a number of long wood screws to hold the two assemblies of my bolt securely in position. This arrangement is far sturdier than other bolts in which the keeper or striker plate is mounted on the narrow door jamb with a few short wood screws.

I have also designed my bolt so that either assembly, either the bolt assembly or the keeper assembly, may be mounted on the door or the wall, as the installer chooses, or as the structure of the door requires. Also, my bolt is longitudinally symmetrical and requires no added parts; therefore, my bolt may be mounted on either a right-hand door or a left-hand door, whichever position is required.

My bolt is intended, primarily, to give security to a resident or a family while he or they are within the premises, since the bolt is lockable from the interior, and not capable of being locked from the exterior.

However, I wish to emphasize that my bolt is not restricted to use as a door bolt. There are other uses for my bolt. For instance, a small version is completely adaptable as a bolt for a window.

My bolt may be used on certain types of sliding doors, folding doors, drawers, or other structures where a bolt may hold two adjacent members securely.

My bolt is of simple design, provides a secure lock, is attractive, and can be finished in a style to coincide with existing decor.

I have developed my bolt essentially in two operating assemblies, what I have referred to above as a bolt assembly and a keeper assembly.

The bolt assembly includes an elongated slide bolt movable within a groove formed between a basic member, which I refer to as a slide block, mounted on a first of a pair of adjacent members, and a cooperating enclosing member, which I refer to as a slide plate. The slide bolt has a locking pin opening at one end which is capable of receiving and holding securely a locking pin operable within the keeper assembly which is mounted securely on the second of a pair of adjacent members.

A pair of shoulders at the end of the slide bolt define a narrow channel or passageway communicating with the locking pin opening, allowing a narrow stem connected axially to the locking pin to pass through the passageway.

The keeper assembly includes a basic member which I refer to as a button block upon which there is mounted a cooperating member which I refer to as a button plate. The button block and the button plate cooperate to form a groove in alignment with the groove in the bolt assembly for slidable movement of the slide bolt. The button block has a hole therein essentially at a right angle to the position of the slide bolt and formed to receive therein the locking pin. Also, the hole contains a spring member placed beneath the locking pin to urge the locking pin toward the outer side of the keeper assembly as it is mounted.

Depression of the locking pin into the hole in the keeper assembly causes the narrow stem to be moved into alignment with the narrow channel of the slide bolt so that the slide bolt may move into position directly over the depressed locking pin. Then, release of the pressure against the narrow stem and locking pin permits the locking pin to be urged upwardly into the locking pin opening where it is held securely.

The above objects and advantages of my invention will become apparent from my description of the following preferred embodiments of my invention.

DESCRIPTION OF THE PREFERRED EMBODIMENTS

Figure 1:
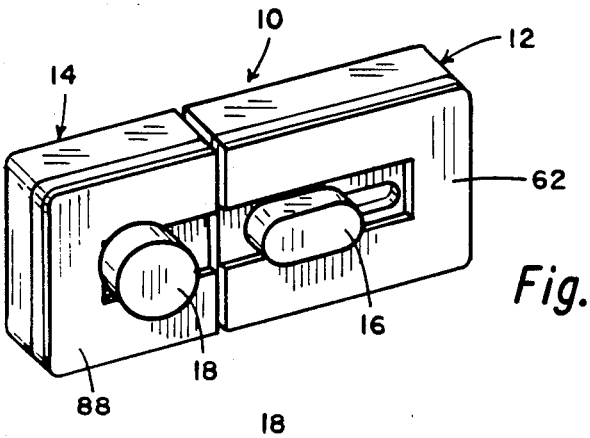
FIG. 1 is a perspective view of a bolt according to my invention showing the bolt in a locking position.

FIG. 1 is a perspective view of a bolt 10, generally, according to my invention, as it would appear in a locked condition. My bolt device 10, generally, comprises a bolt assembly 12, generally, and a keeper assembly 14, generally, which cooperate to perform a locking operation.

Figure 2:
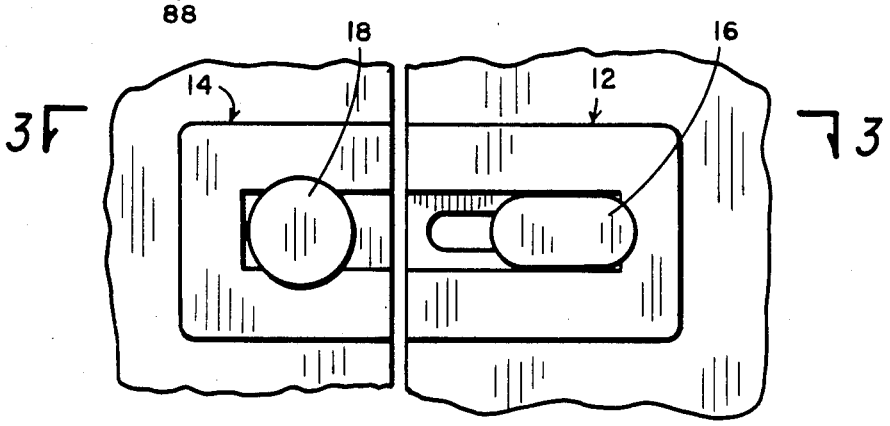
FIG. 2 is a front view of a bolt according to my invention in position on adjacent members which are shown in fragmentary and with the bolt shown in an open condition.
Figure 6:
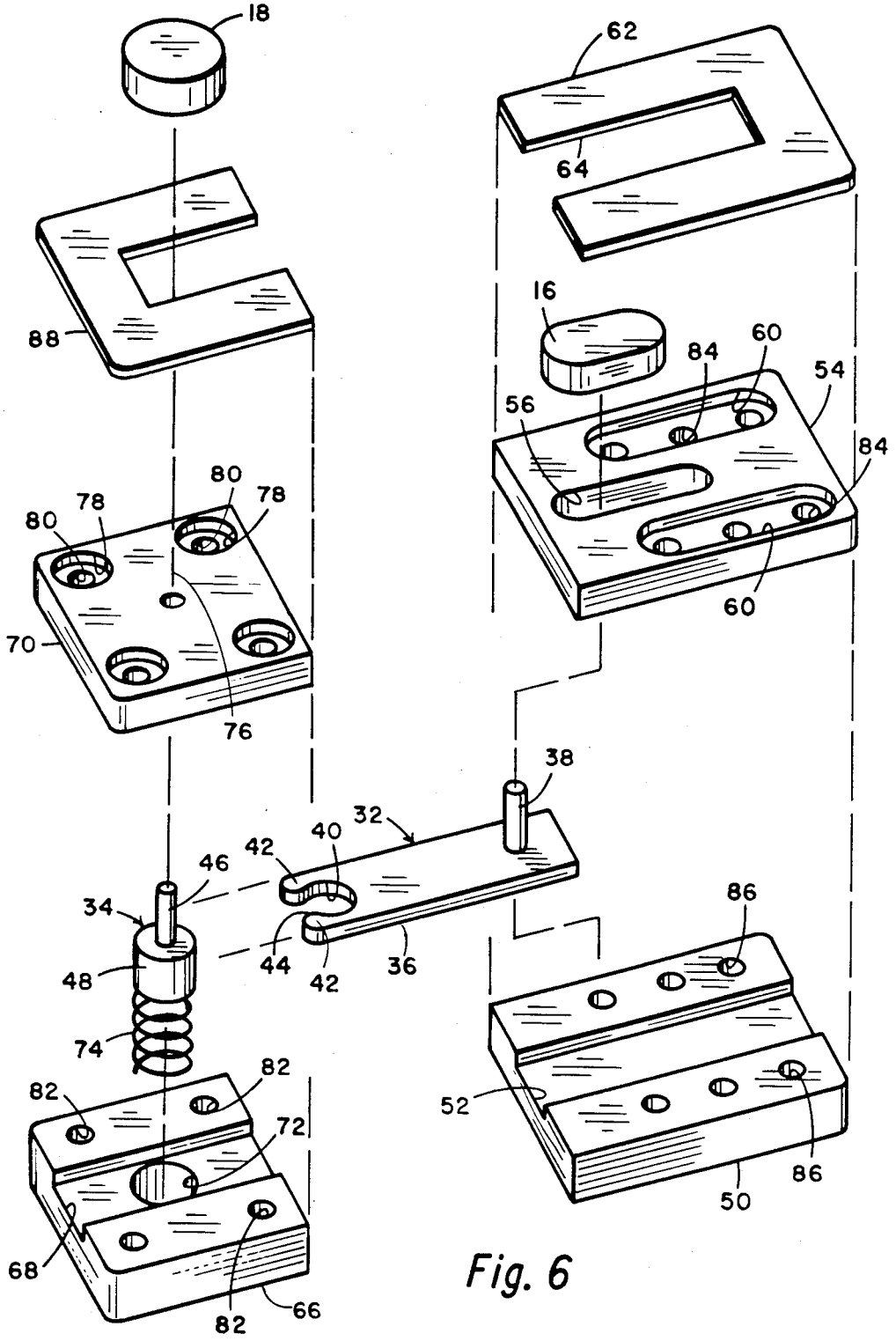
FIG. 6 is an exploded view, in perspective, of a bolt according to my invention showing various components in typical relationship.

Internal components and their relationships are shown in FIG. 6, which is an exploded view for clarity. In FIG. 1 and FIG. 2 I have shown external appearance of my bolt 10, particularly as to the ease by which a locked or unlocked condition may be viewed. As part of the bolt assembly 12, a slide bolt button 16 provides the external means by which a slide bolt on the interior may be moved into and out of a locking condition in cooperation with a locking pin which is depressible by force applied to locking pin button 18.

I have especially designed my bolt to have two special features which are clearly evident in FIGS. 1 and 2. That is, the condition of the bolt, as being either locked or unlocked, may be clearly seen by someone at a considerable distance from the bolt; if the bolt is used in securing the door of a house, this condition may be easily determined from across the room. Also, the bolt 10 may be easily placed in a locked or unlocked condition by using just one hand.

Figure 3:
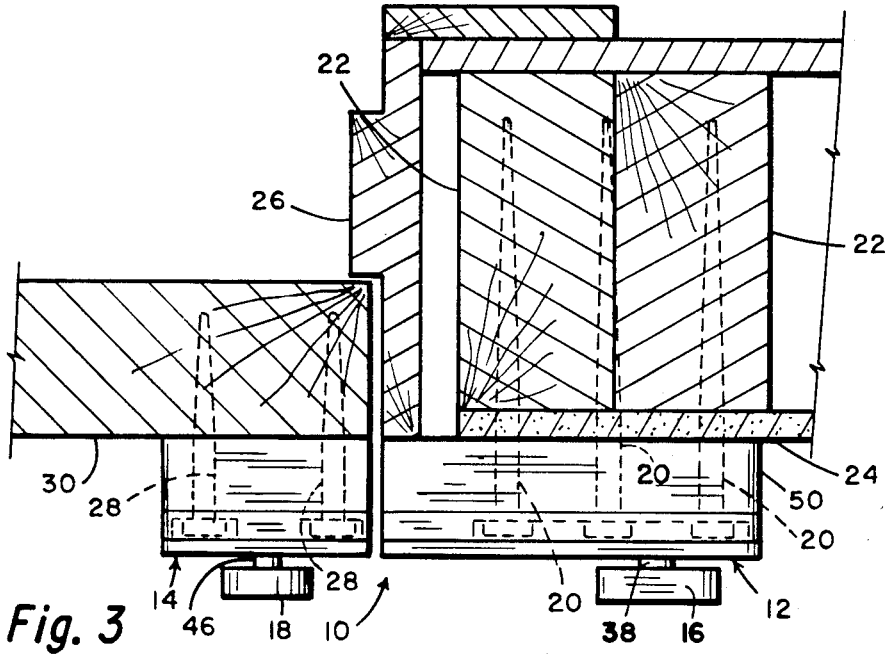
FIG. 3 is a top plan view of a bolt according to my invention showing the bolt mounted on adjacent members which are shown in section.
Figure 5:
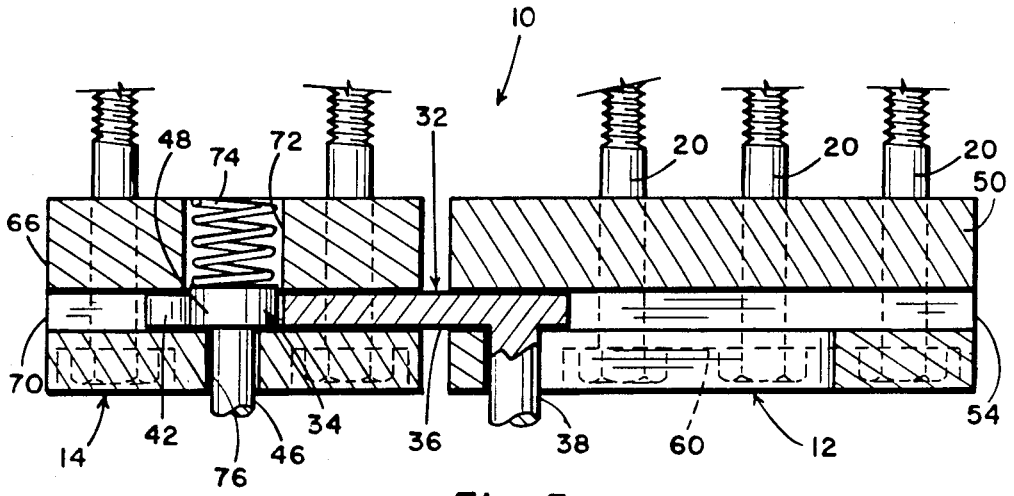
FIG. 5 is a sectional view of a bolt according to my invention along the lines 5—5 of FIG. 4.
Figure 4:
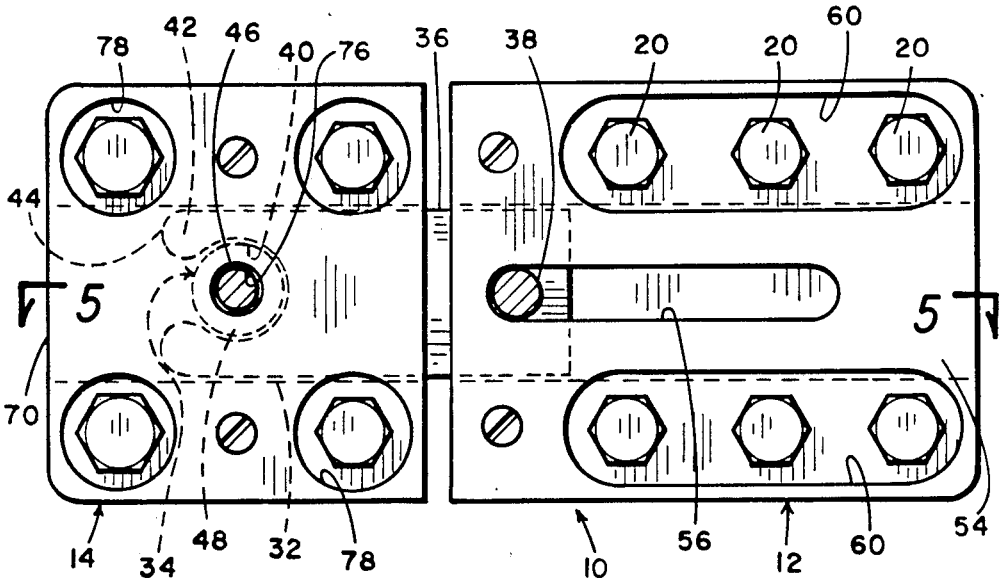
FIG. 4 is a front view of a bolt according to my invention with covering components removed and showing the bolt in a locking position.

FIGS. 3, 4, and 5 describe and emphasize the secure manner in which my bolt may be placed in position. In FIG. 3 I show in phantom the relative size of lag screws 20 which hold bolt assembly 12 securely on wall studs 22 as in one form of mounting on a house door and entry. The long lag screws 20 pass through a typical sheet rock covering 24. As is clearly shown, the mounting of my bolt 10, generally, completely by-passes door jamb 26. A similar set of lag screws 28 are shown holding keeper assembly 14, generally, in secure position on a door 30. The bolt 10, generally, effectively ties the door 30 to the sturdy wall studs 22 because of the secure mounting I have provided for the bolt 10.

FIGS. 3, 4, and 5 show clearly that my bolt 10 may be easily mounted on either a right-hand door or a left-hand door, and also that either major component, bolt assembly 12 or keeper assembly 14 may be mounted on the door with the other component mounted on the door frame. As may easily be understood, for suitable mounting, the proper length of lag screws 20 and 28 may be used in either condition.

FIG. 6 shows the geometry of the various components and their relationship with each other.

The locking operation of my bolt is performed by the cooperation of a slide bolt 32, generally, with a locking pin 34, generally, as shown in FIG. 4, and indicated in FIG. 6. I have shown in FIGURES, 4, 5, and 6 the slide bolt 32 to be an elongated, flat member 36 with a slide bolt control stem 38 adjacent to or at a first end and a locking pin opening 40 adjacent a second end. A pair of shoulders 42 at the second end are spaced apart a suitable distance to define a narrow passageway 44 communicating with the locking pin opening 40. The passageway 44 is slightly larger than the diameter of a stem 46 positioned axially on locking pin 34, but smaller than a pin portion 48 of locking pin 34, generally. In a locked position, pin portion 48 is held securely within locking pin opening 40. Most conveniently, the locking pin opening 40 and the locking pin portion 48 are cylindrical.

The bolt assembly 12, generally, includes a slide block 50 which, in this embodiment, includes a recess or channel 52 longitudinally thereof in which the slide bolt 32, generally, is positioned for slidable movement.

A slide plate 54 is positionable upon the slide block 50 to cooperate with the slide block 50 in providing a recess or tunnel for control of the movement of the slide bolt 32, generally. In this version I have shown a channel 52 in the slide block 50 and a flat lower surface of slide plate 54 which form the recess for the slide bolt 32, generally. However, the channel may easily be formed in the lower surface of slide plate 54 with slide block 50 having a flat upper surface, if desired or necessary, or even be formed in both the slide block 50 and the slide plate 54.

Slide plate 54 has a narrow, longitudinal groove or slot 56 to receive therethrough the control stem 38 by means of which the slide bolt 32, generally, may be manually moved slidably within the bolt assembly 12, generally. The button 16 is secured to stem 38 for ease of handling.

Slide plate 54 has recesses 60 in the upper side so that lag screws 20 may be mounted with the upper surfaces of the heads flush with or below the upper surface of the slide plate 54. A flat top cover 62 is positionable upon the slide plate 54 for decorative purposes by any suitable means, such an adhesive means or by a circumferential clamp, and includes a central slot 64 to accomodate movement of the control stem 38.

The keeper assembly 14, generally, comprises a button block 66 which I have shown as having a channel 68 in alignment with the channel 52 of the slide block 50, to receive a portion of the slide bolt 38 for locking. A button plate 70 is mounted upon the button block 66 for cooperation with button block 66 in providing a recess for the further movement of slide bolt 32, generally, and containment of the locking components. Thus, button block 66 includes an opening 72 into which a spring member 74 is positioned beneath pin 48 in a manner to urge locking pin 34 upwards against the lower surface of button plate 70. Button plate 70 includes an opening 76 therethrough which permits stem 46 to pass through to the exterior to be capped by button 18.

As I mentioned above with respect to the channel 50, the channel 68 may be formed in the same type of cooperation between button block 66 and button plate 70. The proper recess may be formed in any suitable cooperation between these components.

Button plate 70 includes recesses 78 around each hole 80 for lag screws 28, to permit the upper surface of these lag screws to be flush with or below the surface of button plate 70. Holes 80 are in alignment with holes 82 in the button block 66 for lag screws 28 for secure mounting of the button assembly 14. Then, similarly, slide plate 54 has openings 84 in alignment with holes 86 in button block 50, for passage of lag screws 20 for secure mounting.

A top cover 88 is mountable on button plate 70 by any convenient means as with top cover 62.

As I mentioned above, either slide block 50 or button block 66 may be mounted on either the door or door frame when my bolt is used for a lock on a door, as desired.

Upon being properly mounted, and in an initial unlock position, slide bolt 32, generally, is resting within the recess formed in the bolt assembly 12, generally, and pin 48 is urged tightly against the lower surface of button plate 70. Then, to perform the locking operation, pressure is applied to locking pin button 18 to compress spring 74 and move pin 48 into the opening 72. At this time, stem 46 is placed in alignment with passageway 44. Then, slide bolt 32, generally, is moved along the channel 52 and channel 68 so that stem 46 is received through passageway 44 and locking pin opening 40 is directly above the pin 48 which had been depressed into opening 72. Then, upon release of pressure against button 18, the spring 74 urges the pin 48 into the locking pin opening 40, and the locking operation is complete and secure.

Unlocking the bolt is accomplished simply by depressing button 18 to remove locking pin 48 from locking pin opening 40 in order that slide bolt 32, generally, may be moved back into position within channel 52 with consequent passage of stem 46 through passageway 44.

Since many different embodiments of my invention may be made without departing from the spirit and scope thereof, it is to be understood that the specific embodiments described in detail herein are not to be taken in a limiting sense, since the scope of my invention is best defined by the appended claims.

I claim:

1. A bolt mountable on adjacent members to hold the members lockably secure, comprising:

a bolt assembly mountable on a first member of the pair of adjacent members, including a slide bolt movable slidably in the bolt assembly and comprising an elongated, flat member having a first end and a second end, a slide bolt control stem at the first end, a locking pin opening adjacent the second end adaptable to receive a locking pin, and a pair of shoulders at the second end spaced apart to define a narrow passageway communicating with the locking pin opening, a slide block mountable on the first member of the pair of adjacent members and slidably supporting the slide bolt, a slide plate having a longitudinal slot receiving therethrough the slide bolt control stem, the slide plate positioned upon the slide block, the slide plate cooperating with the slide block to form a recess therebetween for the slide bolt, a keeper assembly mountable on the second member of the pair of adjacent members, adaptable to receive and hold securably therein the slide bolt, and comprising a button block mountable on the second member of the pair of adjacent members to slidably support the slide bolt when in a locked position, and having an opening therein to receive a locking pin member, the locking pin member comprising a pin fitting lockably into the locking pin opening of the slide bolt and to fit into the button block opening, a spring member positioned in the button block opening and below the pin urging the pin out of the button block opening, and a stem secured axially on the top of the pin, the stem adapted to be received between the shoulders of the slide bolt to permit the pin to be positioned within the locking pin opening, and a button plate positioned upon the button block and cooperating with the button block to form a recess therebetween in line with the recess of the bolt assembly to receive the slide bolt in a locking position, and including a bore therethrough for reciprocal movement of the locking pin member stem, with the button plate restraining upward movement of the pin.

2. A bolt as described in claim 1, wherein the slide block includes a longitudinal channel in the upper side thereof and the slide plate includes a flat lower surface which cooperate to form the recess in the bolt assembly for the slide bolt, and the button block includes a longitudinal channel in the upper side thereof and the button plate includes a flat lower surface which cooperate to form the recess in the keeper assembly for the slide bolt.

3. A bolt as described in claim 2, wherein the locking pin is essentially cylindrical, the locking pin opening is substantially cylindrically shaped, and the button block opening is essentially cylindrically shaped.

4. A bolt as described in claim 3, wherein the spring is a coil spring.

5. A bolt as described in claim 1, wherein the slide plate includes a longitudinal channel in the lower side thereof and the slide block includes a flat upper surface which cooperate to form the recess in the bolt assembly for the slide bolt, and the button plate includes a longitudinal channel in the lower side thereof and the button block includes a flat upper surface which cooperate to form the recess in the keeper assembly for the slide bolt.

6. A bolt as described in claim 5, wherein the locking pin is essentially cylindrical, the locking pin opening is substantially cylindrically shaped, and the button block opening is essentially cylindrically shaped.

7. A bolt as described in claim 6, wherein the spring is a coil spring.

8. A bolt as described in claim 1, wherein the slide block includes a longitudinal channel in the upper side thereof and the slide plate includes a longitudinal channel in the lower side thereof which cooperate to form the recess in the bolt assembly for the slide bolt, and the button block includes a longitudinal channel in the upper side thereof and the button plate includes a longitudinal channel in the lower side thereof which cooperate to form the recess in the keeper assembly for the slide bolt.

9. A bolt as described in claim 8, wherein the locking pin is essentially cylindrical, the locking pin opening is substantially cylindrically shaped, and the button block opening is essentially cylindrically shaped.

10. A bolt as described in claim 9, wherein the spring is a coil spring.

* * * * *